US009896295B2

(12) United States Patent
Allen, Jr. et al.

(10) Patent No.: US 9,896,295 B2
(45) Date of Patent: Feb. 20, 2018

(54) BUFFER, STACKING SYSTEM INCLUDING THE BUFFER, AND METHOD OF BUFFERING

(71) Applicant: A. G. Stacker Inc., Weyers Cave, VA (US)

(72) Inventors: Clarence C. Allen, Jr., Mt. Crawford, VA (US); Eric H. Crowe, Weyers Cave, VA (US); Micah C. Sundstrom, Weyers Cave, VA (US)

(73) Assignee: A.G. STACKER INC., Weyers Cave, VA (US)

( * ) Notice: Subject to any disclaimer, the term of this patent is extended or adjusted under 35 U.S.C. 154(b) by 0 days.

(21) Appl. No.: 14/951,870

(22) Filed: Nov. 25, 2015

(65) Prior Publication Data

US 2016/0145072 A1 May 26, 2016

Related U.S. Application Data

(60) Provisional application No. 62/084,175, filed on Nov. 25, 2014.

(51) Int. Cl.

| | |
|---|---|
| ***B65H 29/34*** | (2006.01) |
| ***B65H 31/30*** | (2006.01) |
| ***B65H 31/20*** | (2006.01) |
| ***B65H 31/32*** | (2006.01) |
| ***B65H 31/38*** | (2006.01) |

(52) U.S. Cl.

CPC ..... *B65H 29/34* (2013.01); *B65H 31/20* (2013.01); *B65H 31/3018* (2013.01); *B65H 31/32* (2013.01); *B65H 31/38* (2013.01); *B65H 2404/1523* (2013.01); *B65H 2404/1543* (2013.01); *B65H 2701/1762* (2013.01); *B65H 2801/15* (2013.01); *B65H 2801/21* (2013.01)

(58) Field of Classification Search

CPC .... B65H 29/34; B65H 31/38; B65H 31/3018; B65H 31/32; B65H 2404/1543; B65H 2404/1544

See application file for complete search history.

(56) References Cited

U.S. PATENT DOCUMENTS 4,796,879 A * 1/1989 Martini ..... B65H 31/30 271/218
4,938,657 A * 7/1990 Benson ..... B65G 57/06 271/188

(Continued)

*Primary Examiner* — Jeremy R Severson
(74) *Attorney, Agent, or Firm* — J-Tek Law PLLC; Jeffrey D. Tekanic; Scott T. Wakeman

(57) ABSTRACT

A buffer apparatus configured to hold a stack of sheets includes an input, first and second side guides each having a face facing transverse to the travel direction, and a backstop facing the input and spaced from the input in the travel direction. The first side guide, second side guide and backstop define a hopper for holding a plurality of the sheets. First and second retractable supports are shiftable from first positions in which a first portion of the respective retractable support projects a first distance into the hopper and a second position in which the first portion of the respective retractable support projects a second distance into the hopper or does not project into the hopper, the second distance being less than the first distance. The at least one second retractable support is located between the input and the at least one first retractable support.

20 Claims, 8 Drawing Sheets

(56) References Cited

U.S. PATENT DOCUMENTS

| | | | | | |
|---|---|---|---|---|---|
| 5,368,288 | A * | 11/1994 | Philipp | B65H 31/38 | 271/215 |
| 5,370,382 | A * | 12/1994 | Wetter | B65H 31/3018 | 271/183 |
| 5,451,044 | A * | 9/1995 | Nakayama | B65H 29/26 | 271/189 |
| 5,730,695 | A * | 3/1998 | Hauschild | B65H 31/32 | 270/39.02 |
| 6,446,962 | B1 * | 9/2002 | Taffertshofer | B65H 29/70 | 271/188 |
| 8,240,652 | B2 * | 8/2012 | De Matteis | B65H 31/32 | 270/39.02 |
| 9,440,816 | B2 * | 9/2016 | Stojanovski | B65H 31/3018 | |
| 2004/0188926 | A1 * | 9/2004 | Tamura | B65H 29/041 | 271/207 |
| 2004/0227282 | A1 * | 11/2004 | Grewe | B26D 7/0675 | 271/218 |
| 2008/0251984 | A1 * | 10/2008 | Caron | B65H 1/06 | 271/3.02 |
| 2012/0132091 | A1 * | 5/2012 | Roth | B65B 63/02 | 100/215 |

* cited by examiner

BUFFER, STACKING SYSTEM INCLUDING THE BUFFER, AND METHOD OF BUFFERING

CROSS-REFERENCE TO RELATED APPLICATIONS

The present application claims the benefit of U.S. Provisional Patent Application No. 62/084,175, filed Nov. 25, 2014, the entire contents of which is hereby incorporated by reference.

TECHNOLOGICAL FIELD

The present disclosure is directed to a buffer and to a stacking system including the buffer and to a method of buffering a stream of sheets using the same.

BACKGROUND

A conventional stacking apparatus 10 is illustrated in FIG. 8. The stacking apparatus 10 is configured for use adjacent to a rotary die cut machine 12 which cuts blanks (not illustrated) from sheets of material, for example, corrugated paperboard. The stacking apparatus 10 includes a receiving or "layboy" section 14 that receives the blanks from the die cut machine 12 and discharges them onto a transfer conveyor 16. The transfer conveyor 16 carries the blanks to an inclined main conveyor 18, and the blanks travel along the main conveyor 18 to its downstream end 20 where they are discharged into a hopper 22.

After the blanks are discharged from the downstream end 20 of the stacker, they impact a backstop 24 and fall onto a receiving conveyor 26 mounted on a lift table 28. As the stack 30 on the lift table 28 grows, the lift table 28 drops, either continuously or periodically, so that the sheets are always falling approximately the same distance from the downstream end 20 of the stacking apparatus 10 onto the lift table 28 or onto the partial stack 30 on the lift table 28. Alternately, the stack may fall onto a fixed-height conveyor and the end of the main conveyor may rise to maintain a constant distance from the top of the stack.

When the stack 30 has reached a desired height, the lift table 28 lowers the stack 30 to a level even with a secondary conveyor (not illustrated), and the receiving conveyor 26 moves the finished stack 30 away from the stacking apparatus 10. When the stack 30 has moved off the receiving conveyor 26, the lift table 28 raises the receiving conveyor 26 to a level for receiving additional sheets from the downstream end 20 of the stacking apparatus 10.

The rotary die cut machine 12 operates substantially continuously, and sheets of material therefore continue to traverse the stacking apparatus 10 and reach the hopper 22 even while a finished stack is being removed from the receiving conveyor 26. During the time that the receiving conveyor 26 is out of position, accumulator shelves 32 are extended to receive sheets as they leave the downstream end 20 of the main conveyor 18. When the receiving conveyor 26 has discharged a completed stack and returned to a position at the downstream end 20 of the main conveyor 18, the accumulator shelves 32 retract and drop the sheets that have accumulated thereon onto the receiving conveyor 26. Additional sheets exiting the downstream end 20 of the stacking conveyor fall onto the stack, and the process repeats until the stack on the receiving conveyor reaches a desired height.

SUMMARY

Stackers as discussed above are well adapted for use with rotary die cut machines. However, it has been found that it is sometimes desirable to capture or buffer incoming sheets of material before they reach the accumulator. For example, digital printers are now in use that print directly onto sheets of corrugated material. The sheets are generally rectangular and have a long dimension and a short dimension.

There are two main differences between the output of digital printers and the output of a conventional stacker that receives sheets from a rotary die cut machine: first, the digital printer outputs printed sheets at a lower speed than the rotary die cutter. Second, die cut sheets are generally cut so that they travel in the direction of their shorter dimension. However, printed sheets are generally printed as they travel in the direction of their longer dimension. In other words, printed sheets travel in a direction offset 90 degrees from the travel direction of die cut sheets. The combination of these factors means that the leading edge of a sheet leaving the digital printer may droop and drop onto the printed surface of a lower sheet in a stack as upstream portions of the sheet continue to move through the printer. The leading edge of a sheet is thus pushed in a scraping manner along the printed top surface of the next lower sheet in the stack until the trailing edge of the sheet exits the nip of the printer and drops onto the stack. This scraping may damage the printing on the surface of the lower sheet.

One aspect of the present disclosure comprises an arrangement that prevents the above described scraping by holding a sheet exiting the digital printer above the stack on the receiving conveyor until the sheet can be released to fall vertically onto the next lower sheet on the stack. This may be accomplished, for example, by providing a selectively extendable structure, which may comprise a shelf and/or one or more selectively extendable rollers, for example, for supporting a printed sheet exiting the digital printer and holding the printed sheet above the stack and/or receiving conveyor until its trailing end exits the nip of the stacker and then allowing the printed sheet to drop onto the stack.

It may also be advantageous to use such a shelf or selectively extendable rollers with rotary die cut machines and/or other feeding devices other than digital printers. Thus, another aspect of the present disclosure involves using the shelf or selectively extendable rollers as a pre-accumulator for certain stackers. Stackers often include movable plates for squaring or tamping a stack as it forms. These tamping structures may perform their tamping function on a stack at a location below the accumulator shelf. In such a case, sheets are tamped as they fall onto the receiving conveyor or immediately after they are dropped by the accumulator shelves. However, in order to provide a more compact hopper and/or better square a stack as it forms, it may be desirable to providing the tamping structures at the level of the accumulator so that stacks can be tamped in the accumulator section before they are released onto the receiving conveyor.

In such a case, the selectively extendable structure, such as rollers, may act as a pre-accumulator or an accumulator for the accumulator to catch a few (e.g., two or three) sheets while the sheets on the accumulator are tamped or squared and before they are dropped onto the receiving conveyor. The tamping structures are maintained at the level of the stack top as the stack forms on the receiving conveyor. When the accumulator shelf is extended to catch falling sheets (when the finished stack is being moved away from the stacking device) the tamping pauses temporarily and sheets accumulate on the accumulator shelf. When the receiving conveyor is back in position, the selectively extendable rollers are extended to receive a small number of sheets while the sheets on the accumulator are tamped and squared, the squared sheets on the accumulator are dropped onto the receiving conveyor, the rollers are retracted to drop sheets onto the top of the stack, and the tamping structures proceed to tamp the sheets falling on the top of the stack.

One aspect of the disclosure comprises a buffer apparatus configured to hold a stack of sheets and that includes an input section, and the sheets arrive at the input section in a travel direction from a source. The apparatus also includes a top, a bottom, a first side guide having a first face facing transverse to the travel direction, a second side guide having a second face facing transverse to the travel direction, and a backstop facing the input of the buffer apparatus and spaced from the input of the buffer apparatus in the travel direction. The first side guide, second side guide and backstop define a hopper for holding a plurality of the sheets of material. The apparatus includes at least one first retractable support that is shiftable from a first position in which a first portion of the at least one first retractable support projects a first distance into the hopper and a second position in which the first portion of the at least one first retractable support projects a second distance into the hopper or does not project into the hopper, and the second distance is less than the first distance. The apparatus includes at least one second retractable support shiftable from a first position in which a first portion of the at least one second retractable support projects a third distance into the hopper and a second position in which the first portion of the at least one second retractable support projects a fourth distance into the hopper or does not project into the hopper, and the fourth distance is less than the third distance. The at least one second retractable support is located between the input and the at least one first retractable support.

Another aspect of the disclosure includes a method of buffering a stream of sheets by forming a stack. The method includes moving a first sheet in a travel direction into a hopper such that the first sheet impacts against a backstop, catching the first sheet on a first set of retractable supports, and retracting the first set of retractable supports and allowing the first sheet to fall onto a second set of retractable supports. The second set of retractable supports is located between the first set of retractable supports and a bottom of the hopper. The method also includes retracting the second set of retractable supports and allowing the first sheet to fall out of the bottom of the hopper.

A further aspect of the disclosure comprises a method that includes providing a buffer apparatus configured to hold a stack of sheets. The buffer apparatus has an input section, a top, a bottom, a first side guide having a first face facing transverse to the travel direction, a second side guide having a second face facing transverse to the travel direction, and a backstop facing the input of the buffer apparatus that is spaced from the input of the buffer apparatus in the travel direction. The first side guide, second side guide and backstop define a hopper for holding a plurality of the sheets of material. The apparatus includes at least one first retractable support shiftable from a first position in which a first portion of the at least one first retractable support projects a first distance into the hopper and a second position in which the first portion of the at least one first retractable support projects a second distance into the hopper or does not project into the hopper, and the second distance is less than the first distance. The apparatus includes at least one second retractable support shiftable from a first position in which a first portion of the at least one second retractable support projects a third distance into the hopper and a second position in which the first portion of the at least one second retractable support projects a fourth distance into the hopper or does not project into the hopper, and the fourth distance is less than the third distance. The at least one second retractable support is located between the input and the at least one first retractable support. The method includes placing the at least one first retractable support in the first position of the at least one retractable support, receiving at least one sheet moving in the travel into the hopper and catching the at least one sheet on the extended at least one first retractable support, placing the at least one second retractable support in the first position of the at least one second retractable support, shifting the at least one first retractable support to the second position of the at least one first retractable support and allowing the at least one sheet to fall onto the at least one second retractable support, and shifting the at least one second retractable support to the second position of the at least one retractable support and allowing the at least one sheet to fall from the bottom of the buffer apparatus.

BRIEF DESCRIPTION OF THE DRAWINGS

These and other aspects and advantages of the present disclosure will be better understood after a reading of the following detailed description together with the attached drawings in which.

DETAILED DESCRIPTION

Figure 1:
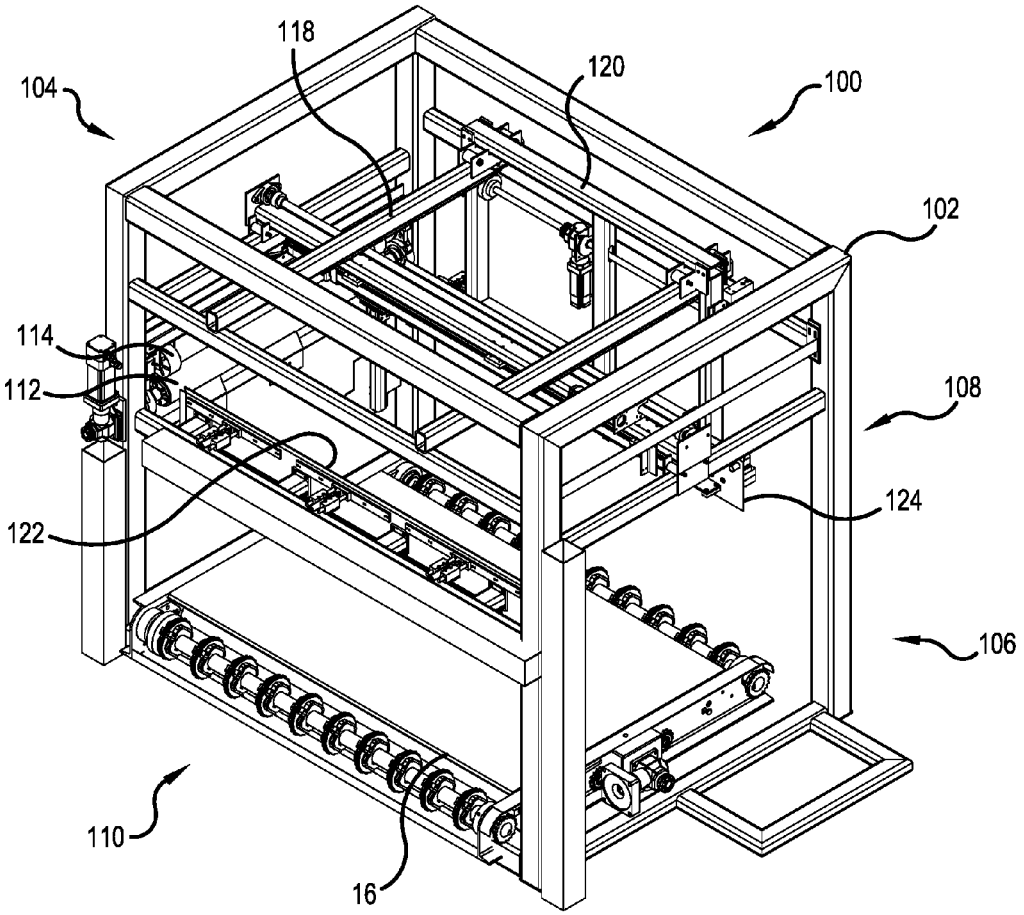
FIG. 1 is a perspective view of a buffer apparatus according to an embodiment of the disclosure.

Referring now to the drawings, wherein the showings are for the purpose of illustrating presently preferred embodiments of the disclosure only and not for the purpose of limiting same, FIG. 1 shows a buffer apparatus 100 for use in a stacking system which buffer apparatus 100 includes a frame 102 having a front 104, a rear 106, a left side 108 and a right side 110. As used herein, the front side 104 is the side from which sheets will enter the buffer apparatus 100 during use, and the terms "left side" and "right side" refer to those respective sides of the buffer apparatus 100 as viewed by a person facing the front 104 of the stacking apparatus. Moreover, the phrases "x-axis" or "x-direction" may be used to refer to the direction from the left side 108 of the frame 102 to the right side 110 of the frame 102. In addition, the phrases "y-axis" or "y-direction" may be used to refer to the direction from the front 104 of the frame 102 to the rear 106 of the frame 102. This direction may also be referred to as the "travel direction," that is, the direction in which sheets travel as they enter the buffer apparatus 100. Finally, the vertical direction may be referred to as the "z-axis" or "z-direction."

Figure 2:
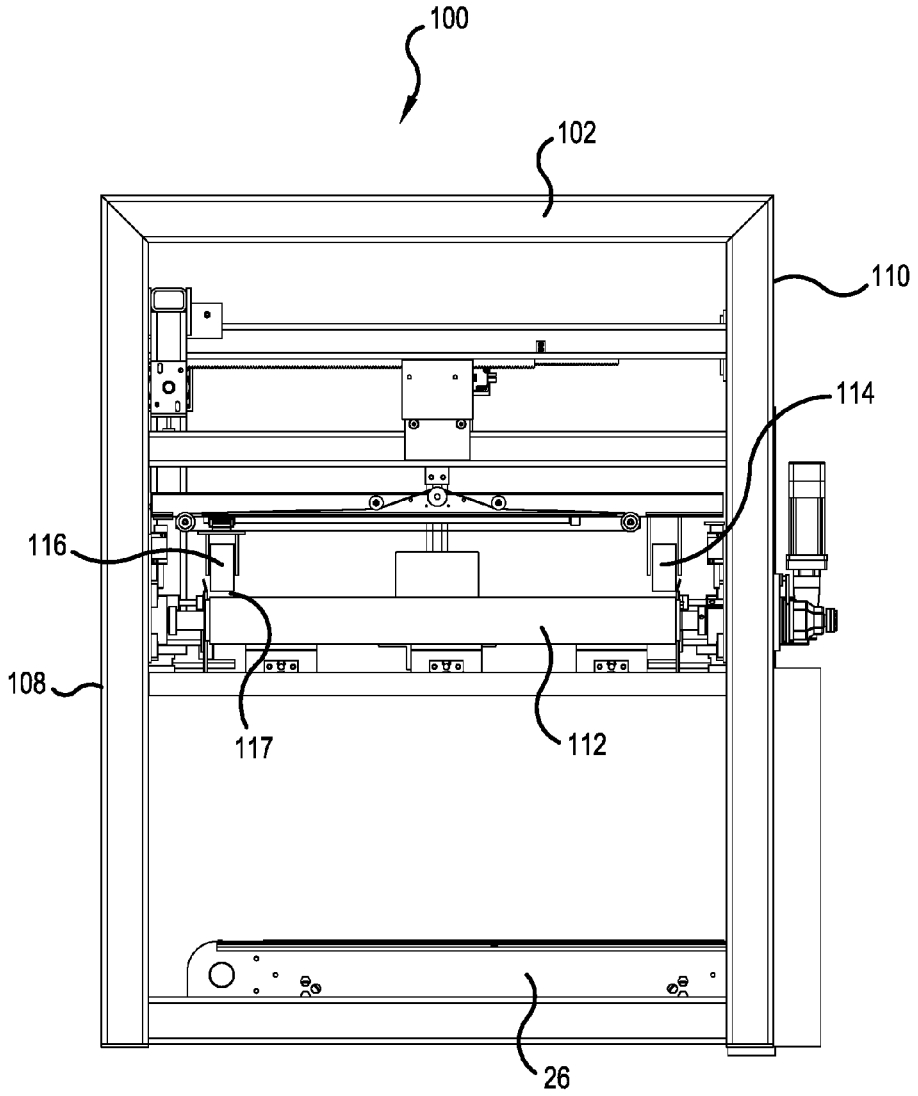
FIG. 2 is a front elevational view of the buffer apparatus of FIG. 1.

A knurled roller 112 is supported at the front 104 of the frame 102, and first and second nip rollers 114, 116 are mounted above the knurled roller 112 and spaced from the knurled roller 112 by a gap 117 (see, e.g., FIG. 2). The gap 117 is selected based on the thickness of the material to be handled by the buffer apparatus 100 such that sheets that arrive at the gap 117 are nipped by the first and second nip rollers 114, 116 and the knurled roller 112 and drawn by the rotation of the knurled roller 112 into the interior of the frame 102. In the disclosed embodiment, the first nip roller 114 is mounted to the frame 102 such that it is fixed in the x-direction, and the second nip roller 116 is mounted so that it is adjustable in the x-direction and such that the distance between the first nip roller 114 and the second nip roller 116 is adjustable. Making the second nip roller 116 adjustable in this manner allows the nip rollers 114, 116 to be used to handle sheets of different widths and to ensure that the first and second nip rollers 114, 116 engage only the edges of the sheets leaving the digital printer. The positioning of nip rollers is less important in conventional stacking operations. However, the nip rollers could potentially damage printing on the top surface of printed sheets exiting a digital printer, and the adjustability of the second nip roller 116 helps avoid such damage. Of course, if desired, the first nip roller 114 could also be adjustable in the x-direction, or, if the incoming sheets are leaving the conveyor section of a stacking apparatus, they will be moving with enough speed that the first and second nip rollers 114, 116 and the knurled roller 112 could be omitted entirely.

The frame 102 includes first and second guide rails 118 mounted near the top of the frame 102 which guide rails 118 extend in the x-direction. A carriage 120 is mounted on the first and second guide rails 118 for rolling or sliding movement in the x-direction. A first side plate assembly 122 is mounted at the right side 110 of the frame 102, and a second side plate assembly 124 is mounted on the carriage 120 so that it is level with the first plate assembly 122 in the z direction and so that the second side plate assembly 124 is movable toward and away from the first side plate assembly 122 in the x-direction.

Figure 3:
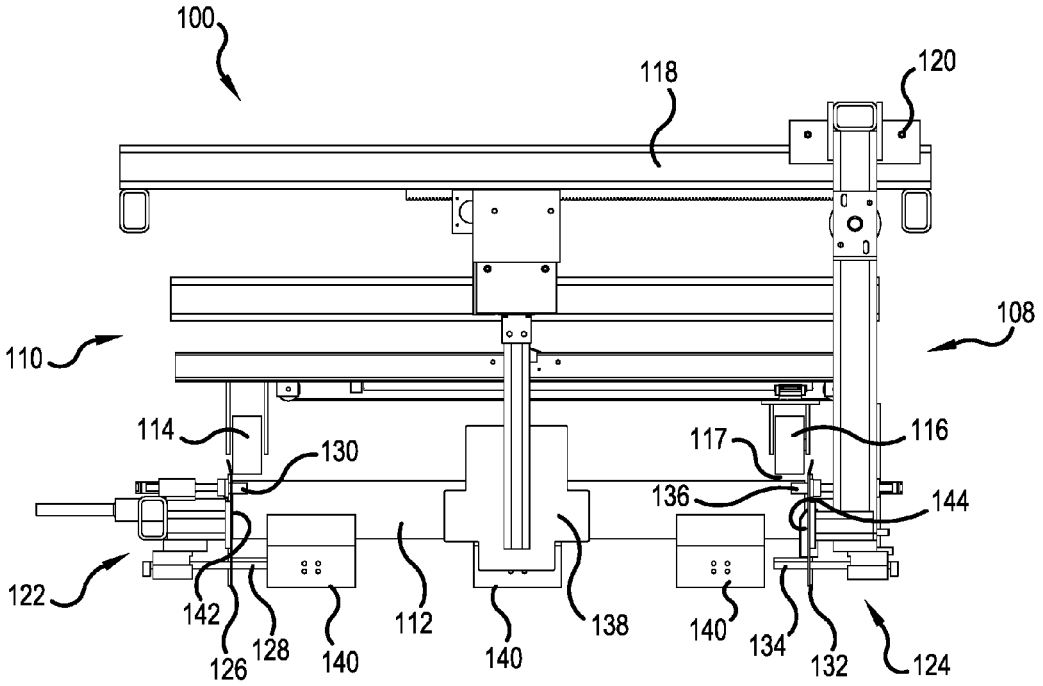
FIG. 3 is a rear elevational views of the buffer apparatus of FIG. 1 in a first configuration.
Figure 4:
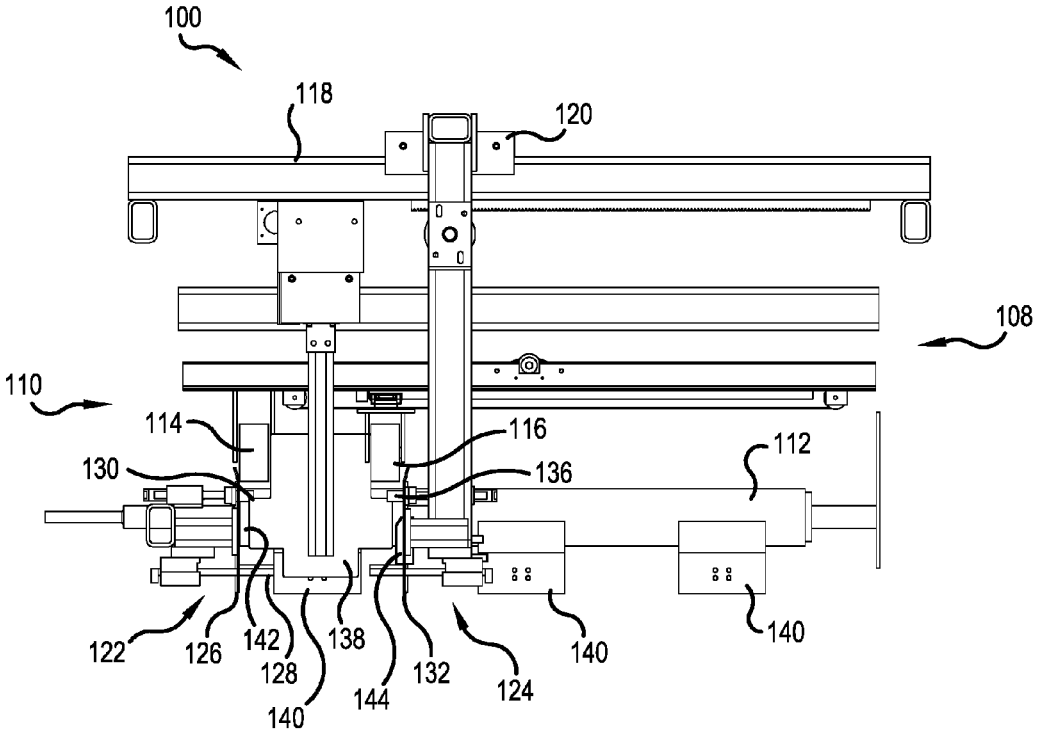
FIG. 4 is a rear elevational view of the buffer apparatus of FIG. 1 in a second configuration.
Figure 5:
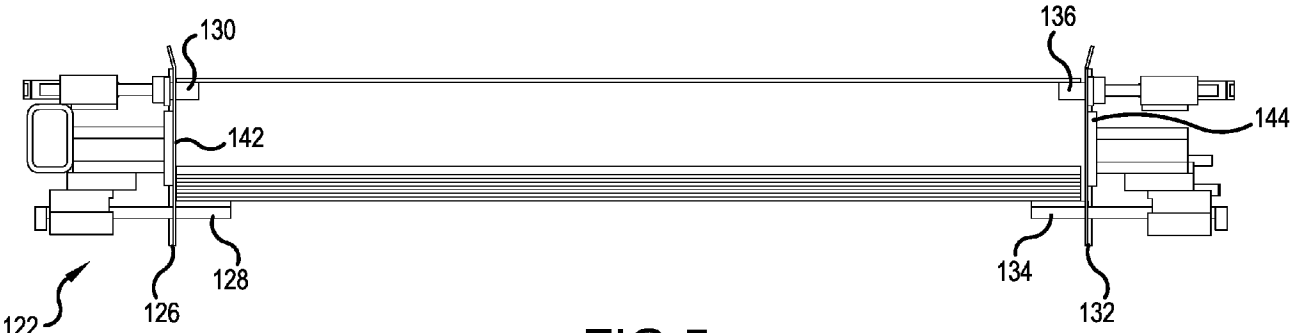
FIG. 5 is an end elevational detail view of the buffer apparatus of FIG. 1 with a first set of sheets stacked on the accumulator and a sheet on the pre-accumulator.
Figure 6:
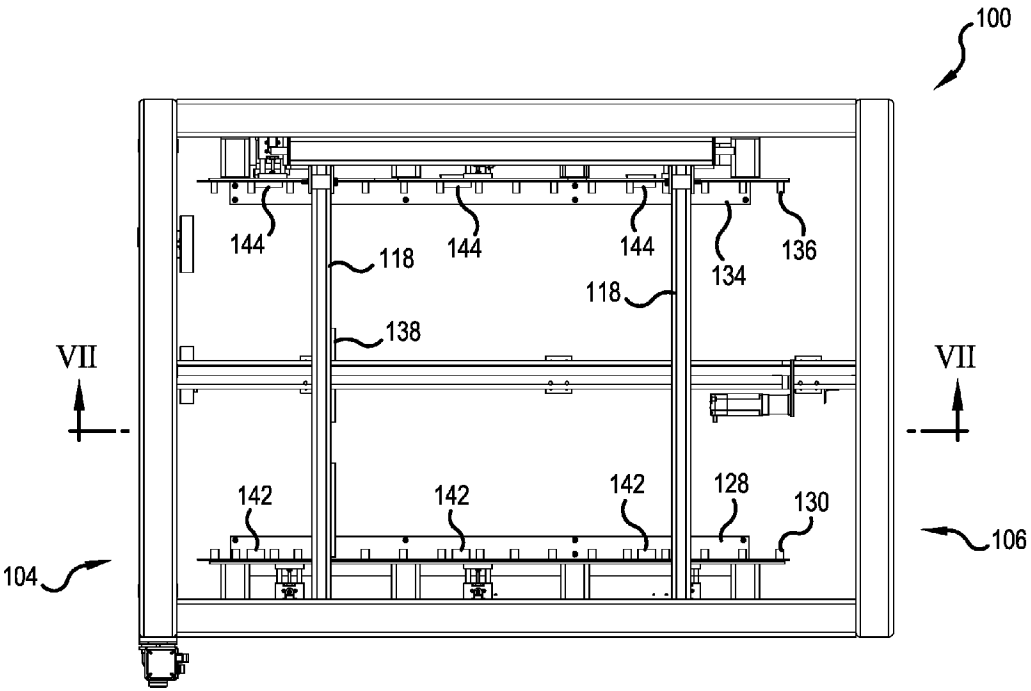
FIG. 6 is top plan view of the buffer apparatus of FIG. 1.
Figure 7:
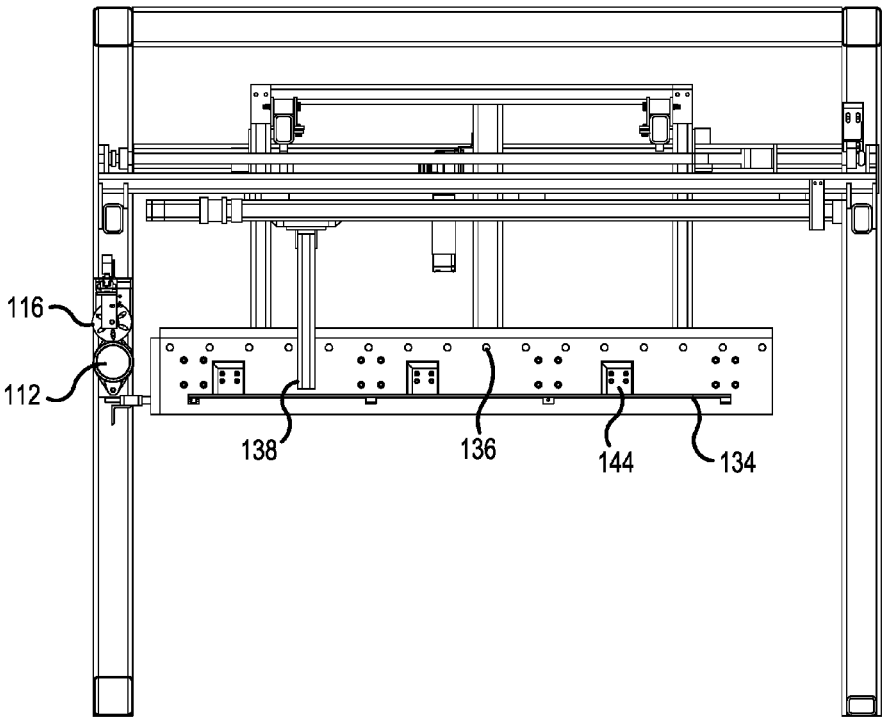
FIG. 7 is a sectional side elevational view taken along line VII-VII in FIG. 6.
Figure 8:
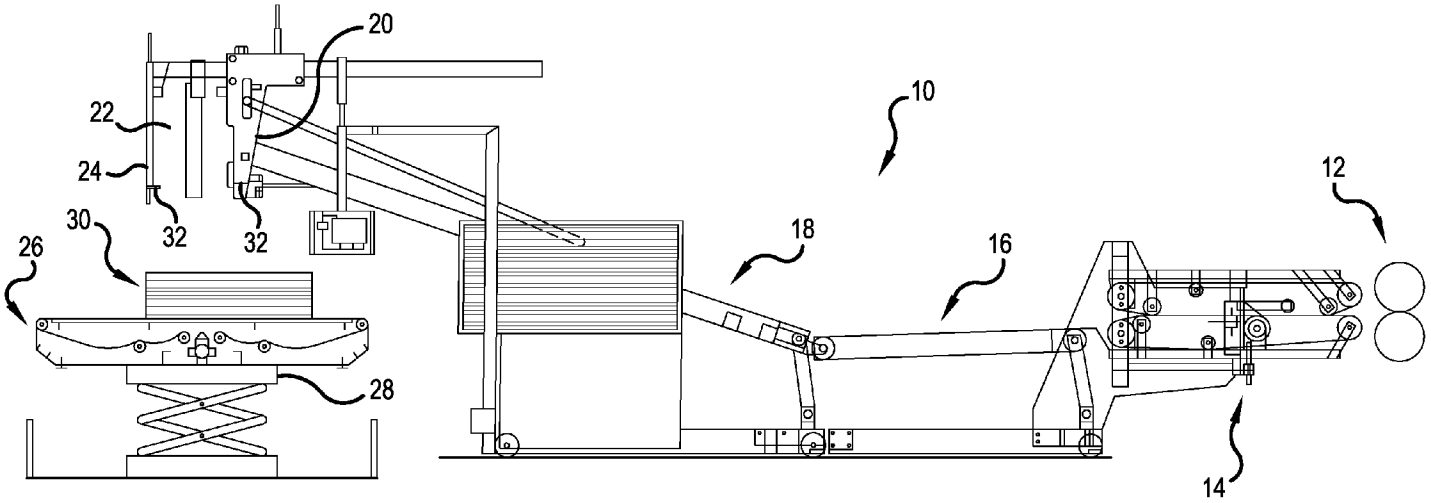
FIG.8 CONVENTIONAL ART
FIG. 8 is a side elevational view of a conventional stacking apparatus.

Referring now to FIG. 3, the first side plate assembly 122 includes a first vertical side plate 126, and a first accumulator shelf 128 is mounted on the side of the first side plate 126 and connected to suitable actuators so that it can be controllably moved toward the side of the frame 102, by extending it through a slot in the first side plate 126, for example. A plurality of first rollers 130, sometimes referred to as "pop-out" rollers, are mounted on the right side of the first side plate 126 plate and connected to actuators that cause the first rollers 130 to extend through the first side plate 126. The first rollers 130 could alternately comprise non-rotatable rods, or a shelf without exceeding the scope of this disclosure. The first rollers 130 may be controlled to move simultaneously or individually or as parts of individually controllable sets of rollers.

The second side plate assembly 124 includes a vertical second side plate 132, and a second accumulator shelf 134 is mounted on the side of the side plate 132 and connected to suitable actuators so that it can be controllably moved toward the first side plate assembly 122, by extending it through a slot in the second side plate 132, for example. A plurality of second rollers 136 are mounted on the side of the side plate 132 and connected to actuators that cause the second rollers 136 to extend through the second side plate 132 toward the rollers 130 on the first side plate assembly 122. The second rollers 136 may also be controlled to move simultaneously or individually or in sets but in any case are preferably aligned with the rollers on the first side plate assembly 122 and configured to extend and retract at the same time as the corresponding first rollers on the first side plate assembly 122.

A backstop 138, which may be adjustable in the x direction and the y direction, is provided on the frame 102 for limiting movement of sheets in the y direction. A plurality of back tamping plates 140 are provided generally in the plane of the backstop. These back tamping plates 140 are movable back and forth in the y direction to tamp and align the sheets of a stack in the y direction.

A set of first side tamping plates 142 is located in the first side plate assembly 122, and a set of second side tamping plates 144 is located in the second side plate assembly 124. (Alternately, tamping can be performed in the x-direction from one side only.) The first and second side tamping plates 142, 144 are movable toward and away from each other in the x direction to align sheets in the x direction and are located above the first and second actuator shelves 128, 134 in the z direction and below the first and second rollers 130, 136 in the z direction. The tamping operation of the back tamping plates 140 and the first and second sets of side tamping plates 142, 144 squares the stack of sheets, and the operation of these tamping plates is discussed in more detail below.

The first accumulator shelf 128, second accumulator shelf 134, first rollers 130 and second rollers 136 are controlled by actuators, such as pneumatic cylinders, electric motors, etc. to move between extended and retracted positions relative to the first side plate 126 and the second side plate 132. The actuators are under the control of a conventional controller, such as a programmable logic controller (PLC), microprocessor, etc. which may be the same controller that controls the overall operation of the stacking apparatus 10. The general concept of controlling the movement of such actuators is well known. The particular arrangement of and manner of controlling the actuators to move the first accumulator shelf 128, second accumulator shelf 134, first rollers 130 and second rollers 136 is part of the disclosed method, and two methods of using the system described above are discussed below.

First, the use of the buffer apparatus 100 for stacking relatively long sheets printed by a digital printer is discussed. Sheets, including corrugated sheets, printed by a digital printer are often printed in their length direction—that is, the sheet is arranged so that its longest dimension is aligned with the y direction of the buffer apparatus 100. As such, the leading end of a sheet may tend to droop and drag along the top surface of a lower sheet in a stack on the receiving conveyor 26 or the accumulator shelf 128 and damage the print on that sheet. This problem is avoided with the present buffer apparatus 100.

The buffer apparatus 100 is positioned at the output end of a digital printer (not illustrated), and the spacing between the first nip roller 114 and the second nip roller 116 is set so that these nip rollers nip the sheet exiting the digital printer close to the side edges of the sheet, i.e., at locations on the sheet that have not been printed. The gap 117 between the knurled roller 112 and the first and second nip rollers 114, 116 is also set so that the rollers can accept and control the movement of the sheet without damaging it.

Before a first sheet is received from the digital printer, the controller causes the first rollers 130 and the second rollers 136 to extend toward each other and through the first side plate 126 and the second side plate 132, respectively. The gap between the first rollers 130 and the second rollers 136 is less than the width of the sheet leaving the printer, and thus the sheet contacts the first and second rollers 130, 136 after it passes the nip rollers 114, 116 and is pushed along the tops of the first and second rollers 130, 136 toward the rear 106 of the frame 102. At approximately the same time as the trailing edge of the sheet leaves the gap 117 between the knurled roller 112 and the first and second nip rollers 114, 116, the controller causes the first rollers 130 and the second rollers 136 to retract, and this releases the sheet from the rollers and allows it to drop onto the surface of the receiving conveyor 26 or accumulator shelf 128 or onto the top of a previously deposited sheet and/or partial stack of sheets that is present on the receiving conveyor 26 or the accumulator shelf 128. The controller cycles the actuators controlling the first and second rollers 130, 136 quickly so that the next printed sheet, which begins to emerge from the gap 117 shortly after the earlier sheet leaves the gap 117, can be received on the rollers 130, 136, and the foregoing process repeats. In this manner, printed sheets are dropped substantially vertically onto the receiving conveyor 26 or onto the accumulator shelf 128 or any partial stack of sheets on the receiving conveyor 26 or the accumulator shelf 128, and the problem of damaging print on sheets already in the stack is avoided.

All of the first rollers 130 and all of the second rollers 136 can be controlled to move simultaneously. Alternately, the rollers 130, 136 may be individually controlled and/or controlled in groups. For example, if it is desired to cause the front end of the sheet to drop onto the receiving conveyor 26 before the rear end of the sheet drops, the rollers closest to the rear 106 of the frame 102 may be caused to retract shortly before the rollers closest to the front 104 of the frame 102 retract. In order to simplify control, the rollers may be retracted in sets. For example, the four rollers closest to the rear 106 of the frame may first be simultaneously retracted, the four centrally located rollers may next be retracted, and the four rollers closest to the front 104 of the frame 102 may be retracted after that. The rollers can then be extended in the opposite order from which they were retracted or all may be re-extended at the same time to receive the next incoming sheet.

The lift table 28 on which the receiving conveyor 26 is mounted is controlled to maintain the top of the stack being formed at a desired height or within a range of heights. Specifically, it may be desirable to maintain the top of the stack above the level of the first and second accumulator shelves 128, 134 so that the side tamping plates 142, 144 can tamp the stack as it forms and, together with the back tamping plates 140, keep the stack square.

The foregoing receiving and releasing process continues until the stack on the receiving conveyor 26 reaches a desired height. At that time, the lift table 28 lowers the receiving conveyor 26 so that the top of the stack drops below the level of the first and second accumulator shelves 128, 134, the controller extends the first and second accumulator shelves 128, 134, and the receiving conveyor 26 moves the finished stack away from the frame 102 of the buffer apparatus 100. The first rollers 130 and the second rollers 136 continue to operate to support sheets exiting the digital printer and to drop them individually onto the stack forming on the first and second accumulator shelves 128, 134. When the receiving conveyor 26 is back in position and ready to receive more sheets, the controller retracts the accumulator shelves 128, 134 and drops the accumulated sheets onto the receiving conveyor and the process of receiving sheets on the first and second rollers 130, 136 continues as before until the new stack on the receiving conveyor has reached a desired height.

The buffer apparatus 100 described above can also beneficially be used to stack sheets that are relatively short, that is, sheets short enough that they do not droop and drag along the top surface of lower sheets in a stack. Specifically, as discussed in greater detail below, the side tamping plates 142, 144, can beneficially be used to tamp and square sheets of a stack on the receiving conveyor 26 as well as to tamp and square sheets that are located on the accumulator shelves 128, 134. Tamping and squaring the sheets being accumulated may contribute to the formation of a neater stack that requires less pressure to square. That is, each sheet is tamped as it drops onto a stack, either on the accumulator shelves or on the receiving conveyor, and this reduces the need to tamp and square multiple sheets at once as might have formerly occurred when a partial stack of sheets was dropped from the accumulator shelves onto the receiving conveyor. If, for example, 10 to 20 sheets accumulate on the accumulator shelves without being squared, these 10 to 20 sheets would have to be squared simultaneously by conventional tamping plates. However, the weight of the upper portion of the stack pressing on the lower sheets of the stack while the sheets are slid in the x-y plane and squared could potentially damage the printing on the lower sheets of the stack. Squaring the sheets as they are accumulated on the accumulator shelves avoids the problem without the need for additional sets of tamping plates.

In operation, the second nip roller 116 and the backstop 138 are positioned to accommodate the dimensions of the shorter sheets being processed. Based on the position of the backstop 138, the controller may control fewer than all of the first and second rollers 130, 136; that is, the rollers 130, 136 that will not contact the shorter sheets being processed in this embodiment may be left idle.

Short sheets pass through the gap 117, impact the backstop 138 and drop onto the receiving conveyor 26 or onto a partial stack forming on the receiving conveyor 26. Because the sheets are short (in the y direction) they do not droop, and they drop substantially vertically onto the stack forming on the receiving conveyor. The first and second rollers 130, 136 are therefore not used to receive and release individual sheets as discussed in the embodiment handling long sheets described above. Instead, the top of the stack is maintained at a level somewhat above the level of the first and second accumulator shelves in the z direction, and the stack is squared by the operation of the back tamping plates 140 and the first and second side tamping plates 142, 144. When the stack reaches the desired height, the first rollers 130 and the second rollers 136 can be used as follows to facilitate the removal of the stack on the receiving conveyor 26.

When the stack reaches a desired height, the first rollers 130 and the second rollers 136 are extended to receive incoming sheets while the lift table 28 drops the stack away from the side tamping plates 142, 144 and back tamping plate 140. When the top of the stack has dropped below the level of the first and second accumulator shelves 128, 134, the first and second accumulator shelves 128, 134 are extended, and the first rollers 130 and the second rollers 136 are retracted to drop the small number of accumulated sheets onto the accumulator shelves 128, 134. The first rollers 130 and the second rollers 136 thus function as a "pre-accumulator" or accumulator for the accumulator shelves 128, 134 in a manner that enables the use of tamping plates as a level higher than the level of the accumulator shelves 128, 134 and helps provide time for the top of the stack to clear the accumulator before the accumulator shelves 128, 134 are extended. The rollers 130, 136 are then retracted, and sheets are deposited directly on the accumulator shelves 128, 134 until the receiving conveyor 26 returns to a position for receiving sheets directly from the printer.

The rollers 130, 136 can be used in a similar manner as pre-accumulators when stacks of long sheets are transferred by the receiving conveyor 26.

The present invention has been described above in terms of several presently preferred embodiments. Additions and changes to these embodiments will become apparent to persons of ordinary skill in the art upon a reading of the foregoing description. It is intended that all such modifications and additions comprise a part of the present invention to the extent they fall within the scope of the several claims appended hereto.

What is claimed is:

1. A buffer apparatus configured to hold a stack of sheets, the buffer apparatus comprising:

an input section, the sheets arriving at the input section in a travel direction from a source;

a top;

a bottom;

a height from the top to the bottom;

a first side guide;

a second side guide facing the first side guide and spaced from the first side guide in a width direction, the width direction being perpendicular to the height and perpendicular to the travel direction;

a backstop extending in the width direction and facing the input of the buffer apparatus and being spaced from the input of the buffer apparatus in the travel direction;

the first side guide, the second side guide and the backstop defining a hopper for holding a plurality of the sheets of material;

at least one first retractable support shiftable in a first direction parallel to a first plane from a first position in which a first portion of the at least one first retractable support projects a first distance into the hopper and a second position in which the first portion of the at least one first retractable support projects a second distance into the hopper or does not project into the hopper, the second distance being less than the first distance; and at least one second retractable support shiftable in a second direction parallel to the first plane from a first position in which a first portion of the at least one second retractable support projects a third distance into the hopper and a second position in which the first portion of the at least one second retractable support projects a fourth distance into the hopper or does not project into the hopper, the fourth distance being less than the third distance;

wherein the at least one second retractable support is located between the input and the at least one first retractable support, wherein the at least one second retractable support is configured to move in the width direction, and wherein the at least one second retractable support comprises a first plurality of rollers and a second plurality of rollers, and wherein the first plurality of rollers and the second plurality of rollers are shiftable toward and away from each other in the width direction.

2. The buffer of claim 1, wherein the at least one first retractable support is configured to move in the width direction.

3. The buffer of claim 1, including a tamper configured to tamp the stack of sheets in the hopper.

4. The buffer of claim 3, wherein the tamper is located between the at least one first retractable support and the at least one second retractable support.

5. The buffer of claim 3, wherein the tamper comprises the first side guide.

6. The buffer according to claim 1, wherein the at least one first retractable support extends through the first side guide.

7. The buffer of claim 6, wherein the at least one second retractable support extends through the first side guide.

8. The buffer of claim 6, wherein the at least one first actuator is configured to move the at least one first retractable support linearly back and forth.

9. The buffer of claim 1, wherein the at least one first retractable support comprises a first first retractable support extending though the first side guide and a second first retractable support extending through the second side guide.

10. The buffer of claim 1, wherein each of the first plurality of rollers has a longitudinal axis of rotation parallel to the width direction.

11. The buffer of claim 1, including at least one first actuator configured to shift the at least one first retractable support between the first and second positions of the at least one first retractable support.

12. A method of buffering a stream of sheets by forming a stack, the method comprising:

moving a first sheet in a travel direction into a hopper such that the first sheet passes between a first side guide and a second side guide separated from the first side guide in a width direction perpendicular to the travel direction, the width direction also being perpendicular to a height direction;

catching the first sheet on a first set of retractable supports;

controlling at least one first actuator to retract the first set of retractable supports in the width direction and allowing the first sheet to fall onto a second set of retractable supports, the second set of retractable supports being located between the first set of retractable supports and a bottom of the hopper;

with the first sheet supported by the second set of retractable supports, retracting the first set of retractable supports a plurality of times and allowing a plurality of additional sheets to fall onto the first sheet on the second set of retractable supports; and controlling at least one second actuator to retract the second set of retractable supports and allow the stack to fall out of the bottom of the hopper.

13. The method of claim 12, wherein the first set of retractable supports comprises at least first and second opposing support members and wherein retracting the first set of retractable supports comprise moving the first and second opposing support members away from one another.

14. The method of claim 12, wherein the first set of retractable supports comprises a first plurality of rollers each having a longitudinal axis of rotation and a second plurality of rollers, and wherein retracting the first set of retractable supports comprises moving the first plurality of rollers and the second plurality of rollers away from each other in a direction parallel to the longitudinal axis of rotation.

15. The method of claim 12, including, after retracting the first set of retractable supports and before retracting the second set of retractable supports, moving a plurality of additional sheets into the hopper and allowing the plurality of additional sheets to fall past the retracted first set of retractable supports onto the first sheet and tamping a stack formed by the first sheet and the plurality of additional sheets on the second set of retractable supports.

16. The method of claim 15, including, after tamping the stack, extending the first set of retractable supports and retracting the second set of retractable supports to allow the stack to fall from the bottom of the hopper.

17. The method of claim 12, wherein controlling the at least one second actuator to retract the second set of retractable supports comprises controlling the actuator to move the at least one second actuator along a first plane.

18. The method of claim 12, wherein moving the first sheet in the travel direction into the hopper includes moving the first sheet such that it impacts against a backstop extending in the width direction, and including tamping the stack on the second set of retractable supports.

19. A method of buffering a stream of sheets by forming a stack, the method comprising:

moving a first sheet in a travel direction into a hopper such that the first sheet passes between a first side guide and a second side guide separated from the first side guide in a width direction perpendicular to the travel direction, the width direction also being perpendicular to a height direction;

catching the first sheet on a first set of retractable supports;

with only the first sheet on the first set of retractable supports, controlling at least one first actuator to retract the first set of retractable supports in the width direction and allow the first sheet to fall onto a second set of retractable supports, the second set of retractable supports being located between the first set of retractable supports and a bottom of the hopper;

after allowing the first sheet to fall onto the second set of retractable supports, moving a second sheet in the travel direction into the hopper such that the second sheet passes between the first side guide and the second side guide;

catching the second sheet on the first set of retractable supports;

with only the second sheet on the first set of retractable supports, controlling the at least one first actuator to retract the first set of retractable supports in the width direction and allow the second sheet to fall onto the first sheet on the second set of retractable supports to form a stack; and controlling at least one second actuator to retract the second set of retractable supports and allow the stack to fall out of the bottom of the hopper.

20. The method of claim 19, wherein the first set of retractable supports comprises a first plurality of rollers each having a longitudinal axis of rotation and a second plurality of rollers, and wherein retracting the first set of retractable supports comprises moving the first plurality of rollers and the second plurality of rollers away from each other in a direction parallel to the longitudinal axis of rotation.

* * * * *